US005253862A

United States Patent [19]

Acquaviva et al.

[11] Patent Number: 5,253,862

[45] Date of Patent: Oct. 19, 1993

[54] ADJUSTABLE NORMAL FORCE EDGE REGISTERING APPARATUS

[75] Inventors: Thomas Acquaviva, Penfield; Vinod K. Agarwal, Webster; Robert P. Siegel, Penfield; Lam F. Wong, Fairport, all of N.Y.

[73] Assignee: Xerox Corporation, Stamford, Conn.

[21] Appl. No.: 812,086

[22] Filed: Dec. 23, 1991

[51] Int. Cl.[5] ..... B65H 5/06

[52] U.S. Cl. ..... 271/251; 271/227; 271/265

[58] Field of Search ..... 271/251, 227, 265

[56] References Cited

U.S. PATENT DOCUMENTS

| | | | |
|---|---|---|---|
| 2,165,161 | 7/1939 | Spiess | 271/251 |
| 2,669,454 | 2/1954 | Babicz | 271/251 |
| 4,257,587 | 3/1981 | Smith | 271/236 |
| 4,322,160 | 3/1982 | Kobus | 355/75 |
| 4,432,541 | 2/1984 | Clark et al. | 271/251 |
| 4,579,444 | 4/1986 | Pinckney et al. | 355/14 |
| 4,605,218 | 8/1986 | Knepper | 271/251 X |
| 4,607,835 | 8/1986 | Wilson | 271/251 X |
| 4,744,555 | 5/1988 | Naramore et al. | 271/251 |
| 4,775,142 | 10/1988 | Silverberg | 271/251 |
| 4,836,527 | 6/1989 | Wong | 271/251 |
| 4,895,359 | 1/1990 | Ookawa | 271/251 X |
| 4,984,779 | 1/1991 | Iwasaki | 271/251 X |

OTHER PUBLICATIONS

Xerox Disclosure Journal, vol. 7, No. 6, Nov./Dec. 1982, pp. 371 and 372, "Document Registration with Ski Assisted Scuffer Wheel", Thomas N. Taylor et al.

Xerox Disclosure Journal, vol. 15, No. 6, Nov./Dec. 1990, p. 473, "Improving the Performance of Crossed Rolls for Side Registration", Vinod K. Agarwal.

*Primary Examiner*—Richard A. Schacher

[57] ABSTRACT

A sheet handler for successively transporting sheet-like material units to and from processing stations in image processing devices such as printers, copiers, and scanners. The sheet handler includes an idler and driven cross-roller set. The rollers are preloaded so that a normal force exists between the rollers at the nip. The nip is positioned in a path for receiving the sheet like material units and to urge such units along the path and into alignment along a registration edge. Apparatus for adjusting the preloaded force are provided to thereby adjust the normal force on sheet-like material passing through the nip.

21 Claims, 6 Drawing Sheets

ADJUSTABLE NORMAL FORCE EDGE REGISTERING APPARATUS

FIELD OF THE INVENTION

This invention relates generally to a sheet handlers often employed in image processing devices such as image input devices, printers, and the like, and more particularly concerns a sheet handler having an active adjustable normal force lateral edge registering apparatus.

BACKGROUND OF THE INVENTION

Sheet handlers with registration systems are well known. Generally, the sheet handlers have a defined path through which the sheet-like material is transported from one station to another. Registration of documents in such paths is commonly accomplished by driving the sheet-like material to a registered condition against a registration edge. Common means for applying the driving force to move the sheet-like material to the registration edge include cross-rollers, a pinch roller, an angle ball on a belt or any other similar well known device. This particular invention is concerned with cross-rollers.

Sheet handlers are often employed to automatically transport sheet-like material, e.g., documents, copy sheets and the like, to and from processing stations in image processing devices, such as image input terminals and printers. Sheet handlers, often for effectiveness, register the sheet-like material during transport thereof. Registration of the sheet-like material in such image processing devices permits accurate, repeatable and, thus, acceptable functioning of such devices.

Sheet handlers used with an image input terminal transport an image bearing sheet-like material, commonly called a document, to an imaging station for recording the image into or onto another medium, e.g., electronic medium, an imaging surface, such as a photoconductive surface and the like. Document handlers used with these terminals have document registration document means so that documents are presented for imaging in a registered form. Failure to register the document in such systems result in a skewed image being recorded.

Sheet handlers are often used in printers to transport sheet-like material such as cut sheets from a holding tray to an imprinting station where the cut sheets have an image recorded thereon. Again, registration means are provided in many printers, as failure to present a registered sheet to the imprinting station often results in a skewed image formed on the sheet and even missing portions of the image. Also, in printers other processing stations such as stapling stations, binding stations, etc. are often provided and registration means in the sheet handler are provided to deliver registered sheet-like material there too.

Sheet handlers generally have a sheet path through which the sheet-like material travels. Actuation of the sheet-like material is often accomplished through roller sets in which one of the sets is driven. Registration of documents, previously mentioned, can be accomplished through the use of cross-rollers.

In cross-roller devices, the rollers generally contact each other in the sheet path at a nip through which the sheet-like material passes. The rollers are arranged to have a normal force between them and, thus, provide a lateral force on the sheet-like material passing through the nip. The cross-rollers are skewed to the direction of travel of the sheet-like material in the path to urge sheet-like material passing between the rollers laterally against a registration edge and normally along the path. That is at some skew angle bisecting the path direction and the lateral direction.

Optimally, the lateral force on the sheet-like material provided by the cross-rollers is sufficient to move the document to and against the registration edge but is insufficient to buckle the sheet-like material upon engagement. That is, the edge of the sheet-like material upon engagement with the registration edge slides along the registration edge, as it slips in the rollers in the lateral direction. In present systems, the normal force, coefficient of friction and skew orientation of the rollers determine the lateral force applied to the sheet-like materials passing therebetween. The beam strength of the sheet-like material in combination with the force applied to direct the sheet-like material determines whether the material moves to engage the registration edge and whether the material buckles upon engagement with the registration edge. Thus, there exists a need to provide a relatively simple, inexpensive and reliable means for remotely adjusting the normal force in cross-roll registration devices in sheet handlers.

The following disclosures may be relevant to various aspects of the present invention:

- U.S. Pat. No. 4,257,587; Inventor: Smith; Filed: Mar. 24, 1981
- U.S. Pat. No. 4,322,160; Patentee: Kobus; Issued: Mar. 30, 1982
- U.S. Pat. No. 4,432,541; Patentee: Clark et al.; Issued: Feb. 21, 1984
- U.S. Pat. No. 4,579,444; Inventor: Pinckney et al.; Filed: Apr. 1, 1986
- U.S. Pat. No. 4,744,555; Inventor: Naramore et al.; Filed: May 17, 1988
- Publication: Xerox Disclosure Journal; Author: Thomas W. Taylor, et al.; Issue: Vol. 7, No. 6, November/December 1982
- Publication: Xerox Disclosure Journal; Author: Vinod K. Agarwal; Issue: Vol. 15, No. 6, November/December 1990; Published: Dec. 22, 1990

The relevant portions of the foregoing references may be summarized as follows:

U.S. Pat. No. 4,257,587 discloses a document registration and feeding apparatus for moving a document allowing a predetermined path and moving the document to a registration edge. The motive force is a deformable scuffer wheel mounted in a flexible drive shaft so that the force applied to documents are limited thereby.

U.S. Pat. No. 4,322,160 discloses a force limiting device used in registering documents on a platen in a document handler. The platen is lowered to expose a registration edge which engages a document adhering to a friction belt to align it for imaging. The platen is raised and lowered by a motor which in combination with the movement of the platen away from the belt adjusts the driving force on the document.

U.S. Pat. No. 4,432,541 discloses an apparatus consisting of a drive roll that is skewed in the direction away from the fixed side edge guide driving an idler roll that is skewed at a greater angle toward the side edge guide whereby when the sheet moves between the drive roll and the guide roll it is laterally driven by the small idler roller to the edge guide and due to the greater coefficient of friction of the idler roller is held against the edge as it is driven forward by the drive roll. The skewing of the drive roll is provided to reduce the chance of damage to the sheet as it is laterally driven by the idler roller.

U.S. Pat. No. 4,579,444 discloses a document side edge registration and deskewing means which includes mated, skewed drive and idler rollers. Take away rollers are also provided in the document path to direct the document sheet through a series of guides. The document enters the nip between the drive and idler roller and the take away rollers are then removed to allow the document to be directed to the registration edge.

U.S. Pat. No. 4,744,555 discloses an idler roller pair mounted on a common shaft and spaced from one another to define a gap therebetween. The idler roller pairs are positioned in conjunction with a drive roller so that the drive roller occupies the space between the idler rollers. The idler roller pairs are skewed so that the longitudinal axis of the respective drive shafts is at a transverse angle with respect to the registration edge mounted on the side of a tray. As a sheet passes through the gap between the drive roller and its pair of idler rollers, it is urged to the registration edge whereupon it continues in the sheet feed direction. The normal force is self limiting, as deformation of the document at the drive wheel limits the normal force according to characteristics of the document. Thus, upon engagement with the registration edge, the document slips under the force in the engagement direction, but continues to advance in the forward direction.

Volume 7, No. 6, pages 371–372 of the Xerox Disclosure Journal discloses a ski-like member which is mounted to a scuffer wheel to effect registration of a document. The scuffer wheel is so mounted to the ski-like member that buckling of the document reduces the force applied by the scuffer wheel to the document.

Volume 15, No. 6 page 473 of the Xerox Disclosure Journal discloses that copy sheet side registration is important and commonly achieved by crossed-rolls. The article states that "An improved crossed-rolls side registration system may be accomplished by automatically adjusting the angle between the driver of the crossed-rolls and the registration edge using for example a small motor or adjusting the normal force between the driver and the idler, or both." The article further states that "a further extension of the improvement would be to automate sensed information with a machine stored look-up table and automatically adjusting the crossed-rolls and registration edge angle or normal force, or both for optimum performance."

Further, there are references which show variable nip or normal force in retard separator/feeders, including belts and roller feeders. Among these references are U.S. Pat. Nos. 4,750,727 and 4,750,726 which disclose apparatus for increasing feeder force applied to a stack of sheet-like material until feeding of a single sheet occurs. Similar, disclosures are found in U.S. Pat. Nos. 4,561,644, 4,475,732, 5,056,604, and 4,368,881 and art cited therein, as well as U.S. Ser. No. 07/767,456.

All of the above described patents, applications and references suffer, as stated above, from various deficiencies. But, specifically, they either fail to teach or fail to provide a means able to compensate to handle a wide range of paper and other materials used in image processing devices including image input terminals, printers and copiers.

That is, a significant disadvantage of these systems is the potential damage to sheets as a result of the fixed or relatively fixed driving force which in the case of lighter weight sheets is in excess of the force necessary to buckle the sheet upon engagement with the registration edge. There is also, in the case of heavier weight sheets, the increase jamming of documents in the path or faulty imaging of sheets as a result of the fixed or relative fixed driving forces which are insufficient to drive the sheet to the registration guide. Thus, for particularly light weight sheets buckling often occurs, while with relatively thick, inflexible sheet material the systems fail to drive the sheet to the registration edge, as expected. In this case, jamming or other errors often result, such as a recording or printing a skewed or off-document image.

In accordance with one aspect of the present invention, there is provided an apparatus for registering a sheet during the movement thereof. The apparatus includes a set of cross rollers. Means are provided to adjust the normal force between the cross rollers. The set of rollers are positioned to accept sheets therebetween and to urge sheets passing therethrough both forward along a path as well as laterally toward a registration edge. The lateral movement of the sheet causes the edge of the sheet to engage a registration edge to align the document according to a predetermined path. The lateral movement of the sheet ceases upon engagement and alignment as the normal force selectively applied to the sheet is less than than the force necessary to buckle the sheet but greater than the force necessary to impart lateral motion to the sheet. Thus, upon registration the sheet begins to slip in the rollers in the lateral direction while still being moved in the path or process direction.

Pursuant to another aspect of the present invention, there is provided a relatively simple, active registration means which includes cross-rollers and a registration edge. The normal force between the rolls is adjusted according to sense signals indicative of the nature and quality of the documents or sheets directed between the cross rolls. The sense signals can be part of the user interface with the particular device or may be generated by detectors and delivered to an operator interface or directly to a control unit. The adjustment of the rollers includes an actuator which adjusts the loading force on the rollers. The actuator can be a manual lever used by the operator to adjust the normal force or motive units such as a solenoid or stepper motor. The motive units can be interconnected with the control unit of the sheet handler of the device with which the present invention is associated to provide for automated adjustments. An operator selection and override can be provided on a user interface panel. Thus, the present invention provides a relatively simple, inexpensive and effective registration means which accepts a wide range of sheet like material. Further, the invention by adjusting the force driving the sheet-like material to compensate for various sizes will also increase the useful life of registration edges by reducing the erosion thereof.

Other aspects of the present invention will become apparent as the following description proceeds and upon reference to the drawings, in which.

While the present invention will be described in connection with the preferred embodiment thereof, it will be understood that it is not intended to limit the invention to that embodiment. On the contrary, it is intended to cover all embodiments, modifications, and equivalents as may be included within the spirit and scope of the invention as defined by the appended claims.

Figure 1:
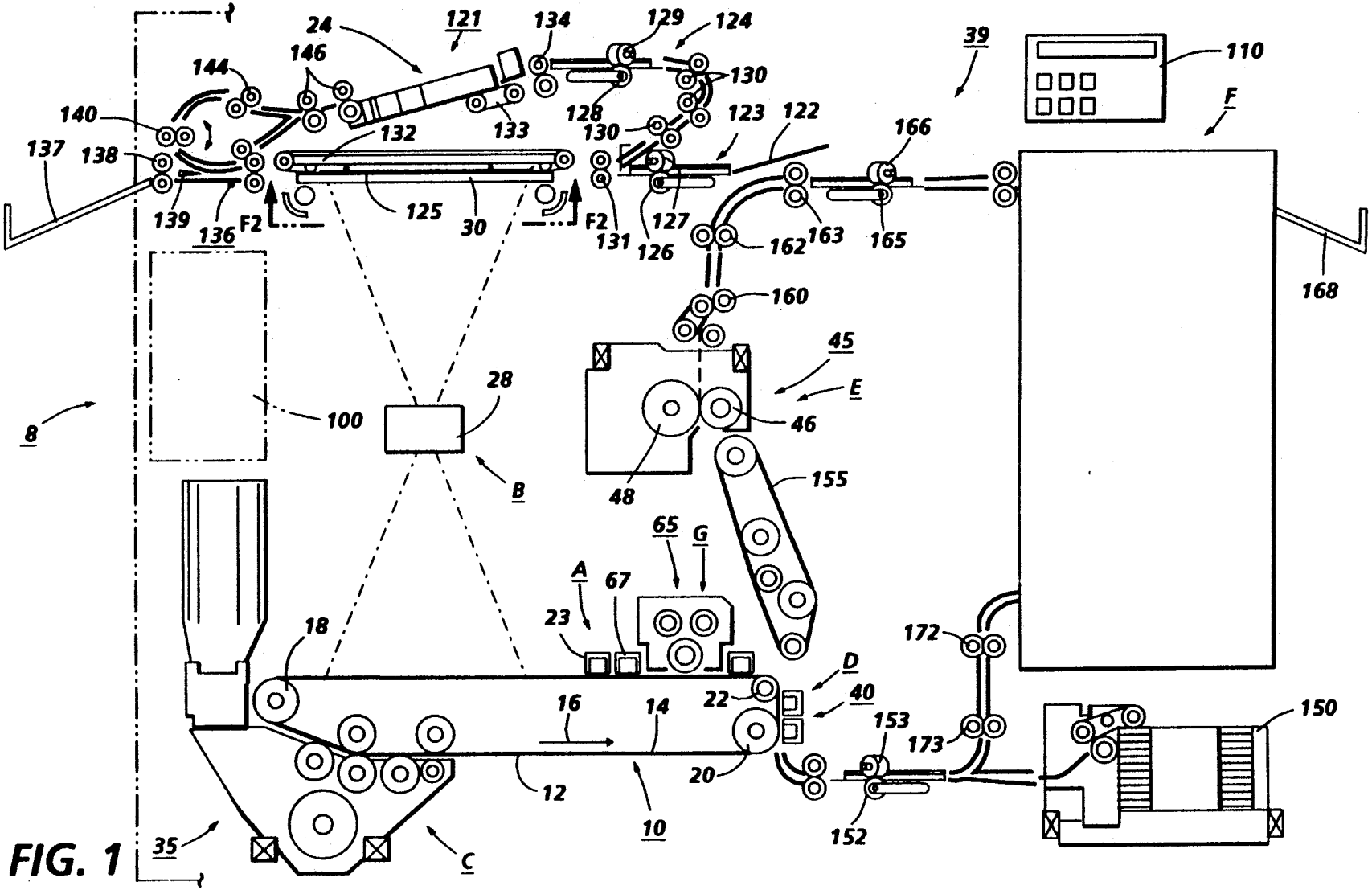
FIG. 1 is a schematic elevational view depicting an illustrative electrophotographic copier machine incorporating several embodiments and uses of the sheet transport and registration apparatus of the present invention.

For a general understanding of the features of the present invention, references should be made to the drawings. In the drawings, like numerals have been used to identify identical elements. FIG. 1 schematically depicts an electrophotographic copier incorporating the features of the present invention therein. It will become evident from the following discussion that the sheet transport and registration apparatus of the present invention may be employed in a wide variety of devices and is not specifically limited in its application to the particular embodiments depicted herein.

Referring to FIG. 1 of the drawings, the illustrative electrophotographic copier machine employs a belt 10 having a photoconductive surface 12 deposited on a conductive substrate 14. The exemplary copier 8 of FIG. 1 includes a conventional photoreceptor belt 10 and conventional xerographic stations acting thereon: charging station A, exposure station B, development station C, transfer station D, fusing station E, finish station F, and cleaning station G. The belt 10 moves in the direction of arrow 16 to advance successive portions of the photoconductive surface 12 sequentially through the various processing stations disposed about the path of movement of this illustrative electrophotographic printing machine. Belt 10 is entrained about by a tension roller 18, driver roller 20 and stripper roller 22. The driver roller 20 is rotationally actuated by a motor by suitable means such as a belt drive.

As roller 20 rotates, it advances the belt 10 in the direction of the arrow 16. Thus, a portion of the photoconductive surface 12 passes through a charging station A. At charging station A, the photoconductive surface 12 is uniformally charged to a predetermined potential. As shown in this example, station A comprises a corona generating device 23 which charges the surface to a relatively high potential.

As the belt 10 advances, the charged portion is passed to an imaging station B. At imaging station B, a document handling unit 24 delivers documents to an imageable position on a platen 30 for imaging the document and exposing the photoconductive surface 12 to form a latent image thereon as shown in the exemplary copier. It will be understood that the schematic light-lens optical input/output system 28 could be replaced by a conventional image input terminal and image output terminal such as a raster input scanner and a raster output scanner.

The portion of the photoconductive surface 12 is then advanced to the development station C. At development station C, the latent image on the photoconductive surface 12 is developed by toner material delivered to the surface. In this case, a magnetic brush developer unit 35 is shown whereby the developer material is attracted to the latent image to form a toner image on the photoconductive surface 12.

The belt 10 then advances to the transfer station D. At transfer station D, a copy sheet is placed in proper alignment by a sheet handling system 39 whereby a copy sheet is moved into contact with the toner image on the surface 12. The sheet has a charge applied thereto by corona generators 40 to attract the toner. Thus, the toner image is transferred to the copy sheet. The copy sheet with the toner image thereon is then advanced to a copy fusing station E.

The fusing station E includes a fuser assembly, generally indicated by reference number 45 which permanently affixes the toner powder on the copy sheet which moves through the sheet handling system 39. Preferably, as shown here the fuser assembly includes a heated fuser roller 48 and a roller 46 so the toner image is permanently affixed to the copy sheet. The copy sheets continue in the sheet handling system 39 after passing the fusing station E are passed to a finishing station F and eventually to a tray 168. The finishing station F can include binding or stapling or the like, as is well known in the art. Further, as shown, the finishing station F can include a return for two sided copies, as is also well known in the art.

The portion of the photoconductive surface 12 after passing the transfer station E then advances to a cleaning station G. The cleaning station G removes residual toner particles and other such material remaining on the photoconductive surface 12. As shown here cleaning station G includes a mounted fibrous or electrostatic brush unit 65 which contacts the photoconductive surface 12 to clean it. A discharge lamp 67 is often placed between the stations G and A to dissipate residual charges remaining on the photoconductive surface to prepare it for the next successive imaging cycle beginning with station A, the charging station.

The machine functions described and other machine functions to be described or as may be useful are regulated by a controller 100. The controller is preferably a programmable microprocessor which controls all necessary machine functions described previously. The controller also provides through known means comparison counts of copy sheets, numbers of documents recirculated by the document handlers, numbers of copy sheets selected by the operator, time delays, jams and the like. Control of all exemplary systems described may be accomplished by conventional control switches input from the printing machine console 110 as selected by the operator. Further, document and copy sheet path sensors and/or switches may be utilized to keep track of the position of documents and sheets moving in their respective paths. In addition, controller 100 regulates the various positions of gates within the system to be described in further detail. Thus, for example, by operator selection of the documents to go to station F for binding or stapling or other specialized functions or the output tray 168, the controller 100 will actuate a decision gate to effect such choice.

Referring still to FIG. 1, the features of the present invention will now be described in greater detail. As shown in this figure, sheet transport systems of the present invention are exemplified both by document handler unit 24 and copy sheet handler 39. That is both are apparatus for transporting sheet-like material successively to and from processing stations of an image processing device and both have means for varying the normal force between cross-rollers to provide greater effectiveness and efficiency in the registration of the sheet-like material transported to and from the processing stations.

In the exemplary document handling system 24 of the illustrative copier 8 of FIG. 1, there is a recirculating input stacking tray 121 and a side entrance shelf 122 for semiautomatic document system 123 into which documents may be individually inserted. The recirculating document handler 124 of the document handling system 24 provides for automatic transport of successive registered and spaced document sheets onto and over a conventional platen imaging station 125. The imaging station shown employs a friction belt platen transport system 132 overlaying the platen 30. In this example, documents are fed one at a time from the bottom of a stack of one or more documents placed in the tray 121 by driven belt 133 to roller set 134, which directs documents to the friction belt transport system 132 for imaging via the cross rollers 128 and 129, roller sets 130 and roller set 131. Documents input from the semiautomatic document system 123 are fed by cross-rollers 126 and 127 and the rollers 131 to the platen transport system 132.

Documents exiting the platen transport system 132 are then directed to the lower two of the three rollers 136. Documents fed from the semi-automatic shelf 122 are directed to output tray 137 via decision gate 139 and rollers 138. Documents input from the tray 121 are directed by gate 139 to roller set 140 which can rotate in a first direction to receive documents from rollers 136 and then either direct the documents to rollers 144 or reverse rotation to redirect the document to pass between the upper two rollers of roller set 136. Documents passing through the upper two rollers of roller set 136 and those passing through the rollers 144 are directed back to tray 121 via roller sets 146. As apparent, the described arrangement of rollers provide for both simplex and duplex imaging of documents placed in tray 121.

As is conventionally practiced, the entire document handler system 24 is pivotally mounted to copier 8 so as to be liftable by the operator away from its active position adjacent the platen. Lifting the document handler away from the platen permits manual document placement on the platen, as well as convenient clearance of jams occurring in the transport system proximate to the platen. The document handler's system has external covers to cover the moving parts which are not shown here for clarity.

In FIG. 1, the sheet handling system 39 feeds documents from an input tray 150 in which copy sheets are stacked to cross rollers 152 and 153. The copy sheets are then fed along the copy sheet path to the transfer stations and then to the fusing station E via belt transport 155. The copy sheets with the fused image thereon continues in the copy sheet path through belt and roller sets 160, 162, 163 to cross rollers 165 and 166. The copy sheets are then passed to the finishing station F. The sheets can then be passed to output tray 168 after desired processing or recirculated for two sided copying via roller sets 172 and 173 to the cross rollers 165 and 166.

Figure 2:
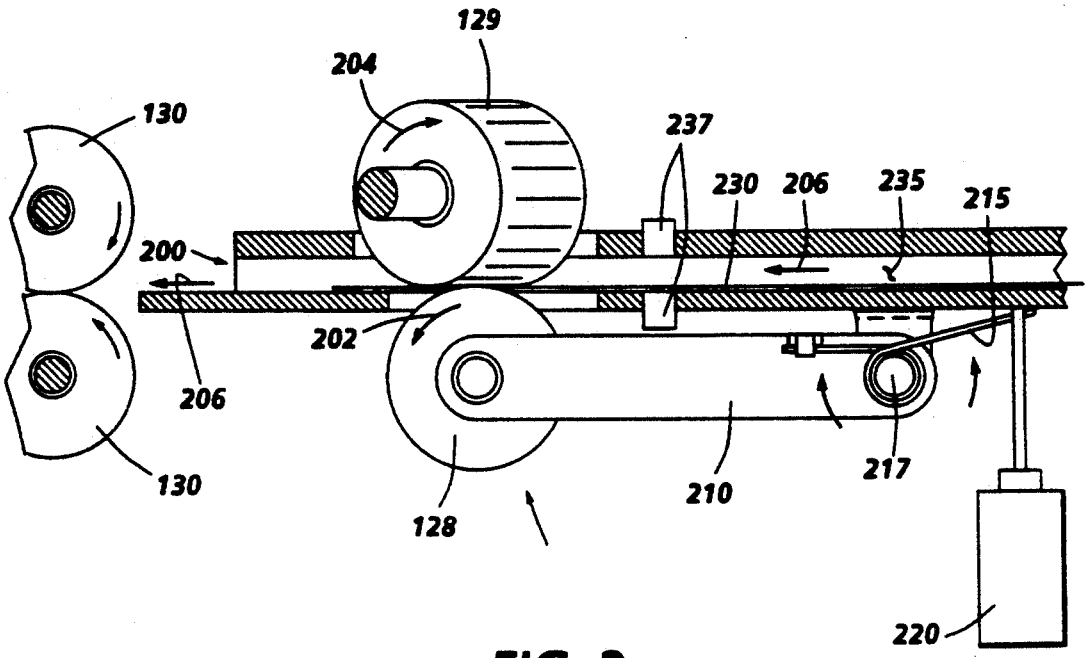
FIG. 2 is a side elevational view of an embodiment of the present invention.
Figure 3:
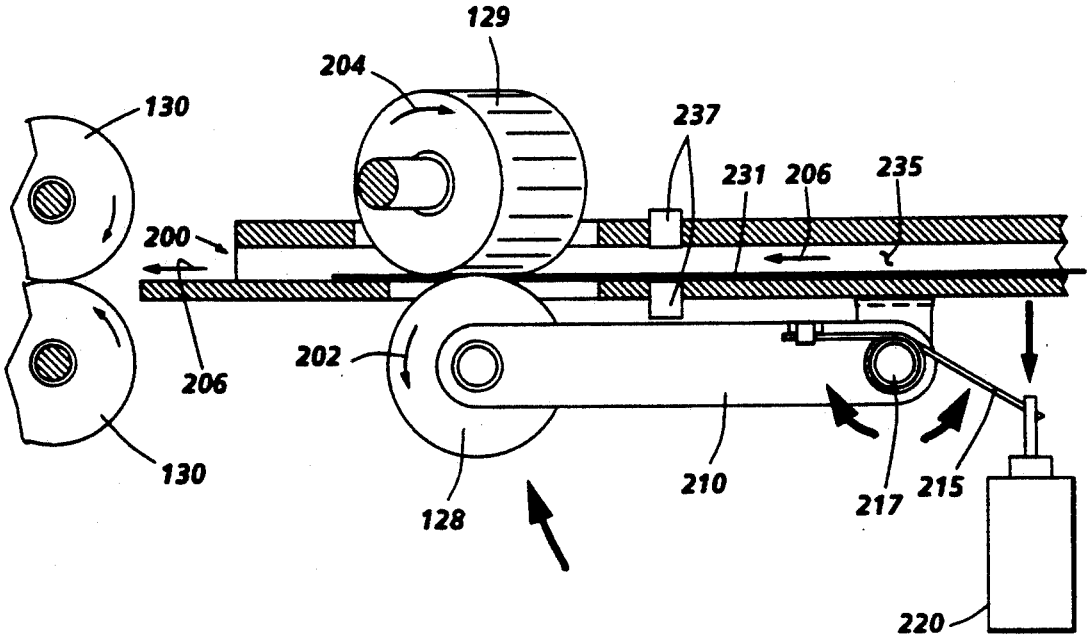
FIG. 3 is a side elevational view of the embodiment of FIG. 2.

Now referring to FIGS. 2 and 3, particularly features of the present invention will now be exemplified in greater detail. Cross-rollers 128 and 129 are shown engaging each other with the nip in the document path 200 with the direction of rotation indicated by arrows 202 and 204 and, thus, the direction of document travel indicated by arrows 206. The roller 129 in this embodiment is driven by a motor (not shown) in a conventional manner, and the roller 128 is mounted for free rotation on arm member 210. Torsion spring 215 is mounted about pivot arm 217. One end of torsion spring is fixed to the arm 210 and the other end is mounted to a suitable motive unit, which can be for example a stepper motor or solenoid 220. Actuation of the solenoid 220 loads the roller to urge engagement of the cross-rollers 128 and 129. That is, the normal force between the rollers at the nip, and thus the lateral force on documents passing between the rollers, is a function of the loading force suppled by the spring 215. It will be appreciated that the force can be varied over a range according to the displacement of the end of the spring 215 by the solenoid 220.

It will be recognized that actuation of the solenoid 220 from a first position shown in FIG. 2 to a second position shown in FIG. 3 acts to further tension the torsion spring 215 and thus increase the normal force at the nip between the cross-rollers 128 and 129. The cross-roller 129 is firmly mounted so that the nip between the cross-rollers 128 and 129 is in the path 200 so that both document 230 in the paper path 200 of FIG. 2 and document 231 in the paper path 200 of FIG. 3 are directed through the nip between the cross-rollers. Thus, by increasing the force, documents having a greater beam strength can be driven to and aligned by a registration edge. Further, decreasing the normal force, reduces the lateral force on the documents to permit relatively light weight documents to engage the registration edge and to translate along it without buckling. The cross-rollers 128 and 129 are also mounted collectively in a skewed fashion to the direction indicated by the arrow 206, whereby the documents 231 and 230 are urged in the direction of the arrow 206 and into a registration edge 235. It will be appreciated that by actuating the solenoid 220 the normal force between the cross-rollers is adjusted and that, therefore, the lateral force applied to the documents 230 and 231 of FIGS. 2 and 3, respectively, is adjusted.

Still referring to FIGS. 2 and 3, an optical detector 237 is shown disposed with a portion over and under the path 200 so as to detect the transmissivity of the documents 230 and 231, respectively, in the path 200. The opacity of the document in many cases will provide an adequate gauge of the force necessary to drive such document to the registration edge and align it without buckling of the document. Thus, the output of the detector 237 is directed to the control unit 100, which processes the information and provides an output signal to actuate the solenoid as appropriate. A particular arrangement of a weight measuring apparatus suitable for use with the present invention is disclosed in U.S. Pat. application Ser. No. 07/627,867.

It will be also understood that a message can be provided at the user interface panel 110 by the output of the control unit 100 in response to the signal from the detector 237 to permit override of the control unit actuation of the solenoid 220. Further, in some cases where the control unit is not directly connected to the solenoid, the message can be provided to the interface panel 110 to advise the user to actuate the solenoid through the appropriate settings on panel 110.

Several known features may be incorporated to this device to further improve its functioning. That is the cross-rollers may be skewed with the leading edge of one directed toward the registration edge at a particular skew angle to the direction 206 and the leading edge of the other directed away from the registration edge at an absolute skew angle to the direction 206 less the particular skew angle. Another feature which can be incorporated is to make the cross-roller at the particular angle have a lower coefficient of friction to the documents than the other cross-roller so that slipage of the document between the cross-rollers in the lateral direction is enhanced upon engagement and alignment of the document with the registration edge. Thus, the lateral force applied to the documents is regulated by the friction. Generally, one of the rollers 128 and 129 is made of a rigid, inflexible material such as steel while the other is formed of a substantially rigid material such as a slightly deformable synthetic material to provide differing coefficients of friction.

Figure 4:
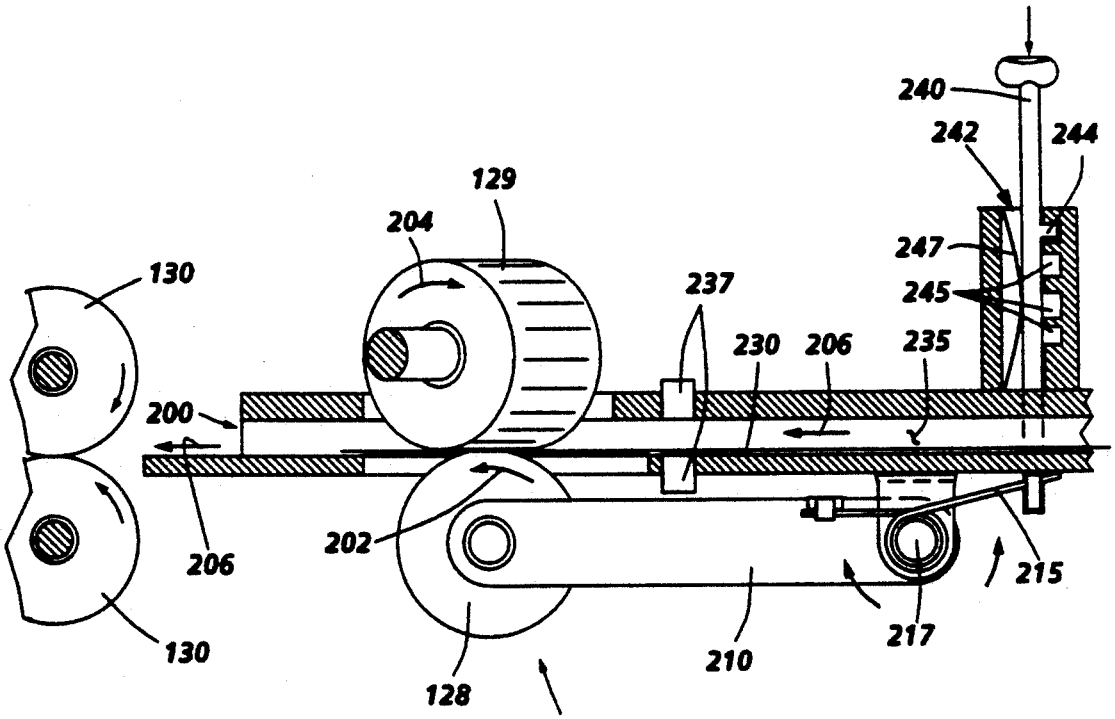
FIG. 4 is a side elevational view of another embodiment of the present invention similar to FIG. 2.

FIGS. 4 shows an embodiment substantially similar to the embodiment of FIGS. 2 and 3. The primary difference is that the other end of the torsion spring is mounted to manual actuator arm 240 which is positioned in a sliding aperture. The arm has tooth 244 which is positionable in slots 245. A spring member 247 is provided in the aperture to releasably retain the tooth 244 in one of the slots 245. It will be appreciated that by manual operation of the arm, the lateral force on document 230 in the path 200 can be adjusted to accommodate documents with various beam strengths. It will be appreciated that the detector 237 can be connected to the panel 110 (FIG. 1) to provide information to the users to move the arm 240 to adjust the lateral force applied to documents passing between the cross-rollers 128 and 129.

Figure 5:
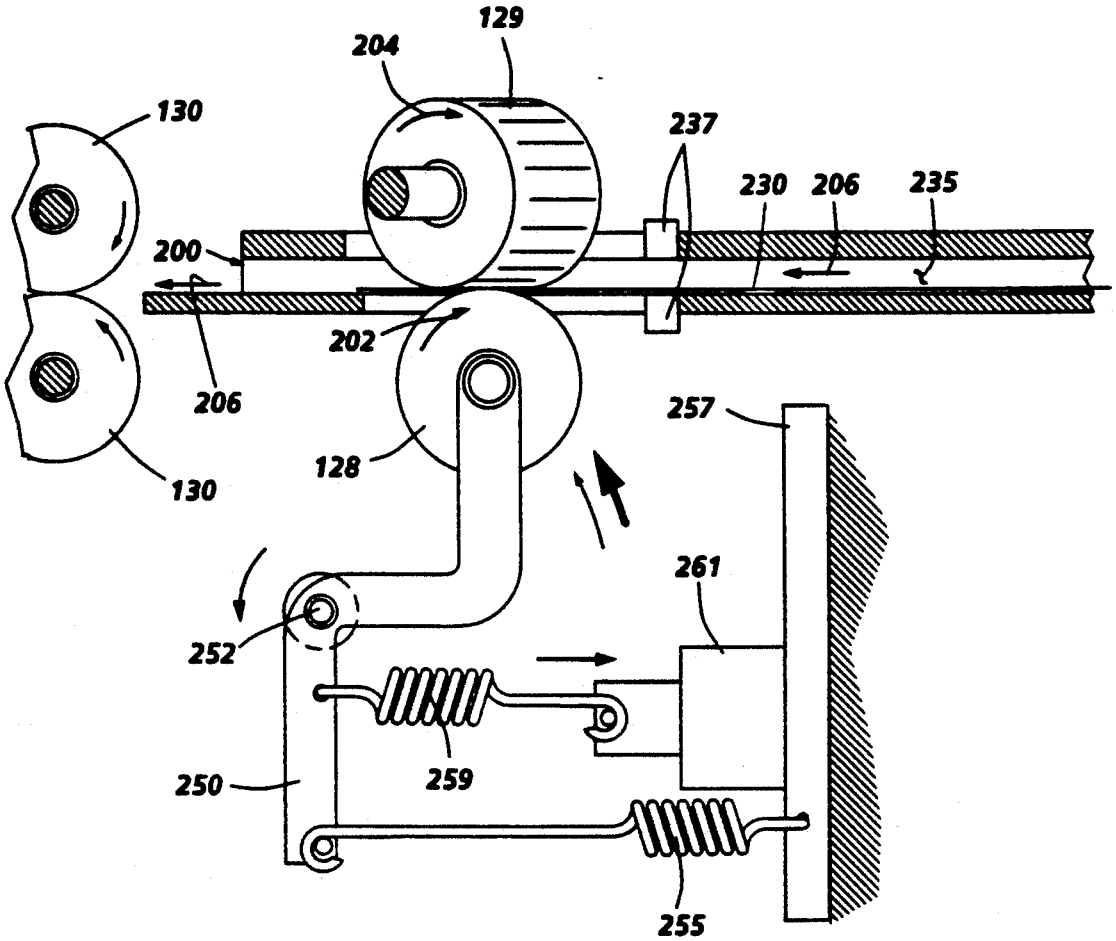
FIG. 5 is a side elevational view of another embodiment of the present invention.
Figure 6:
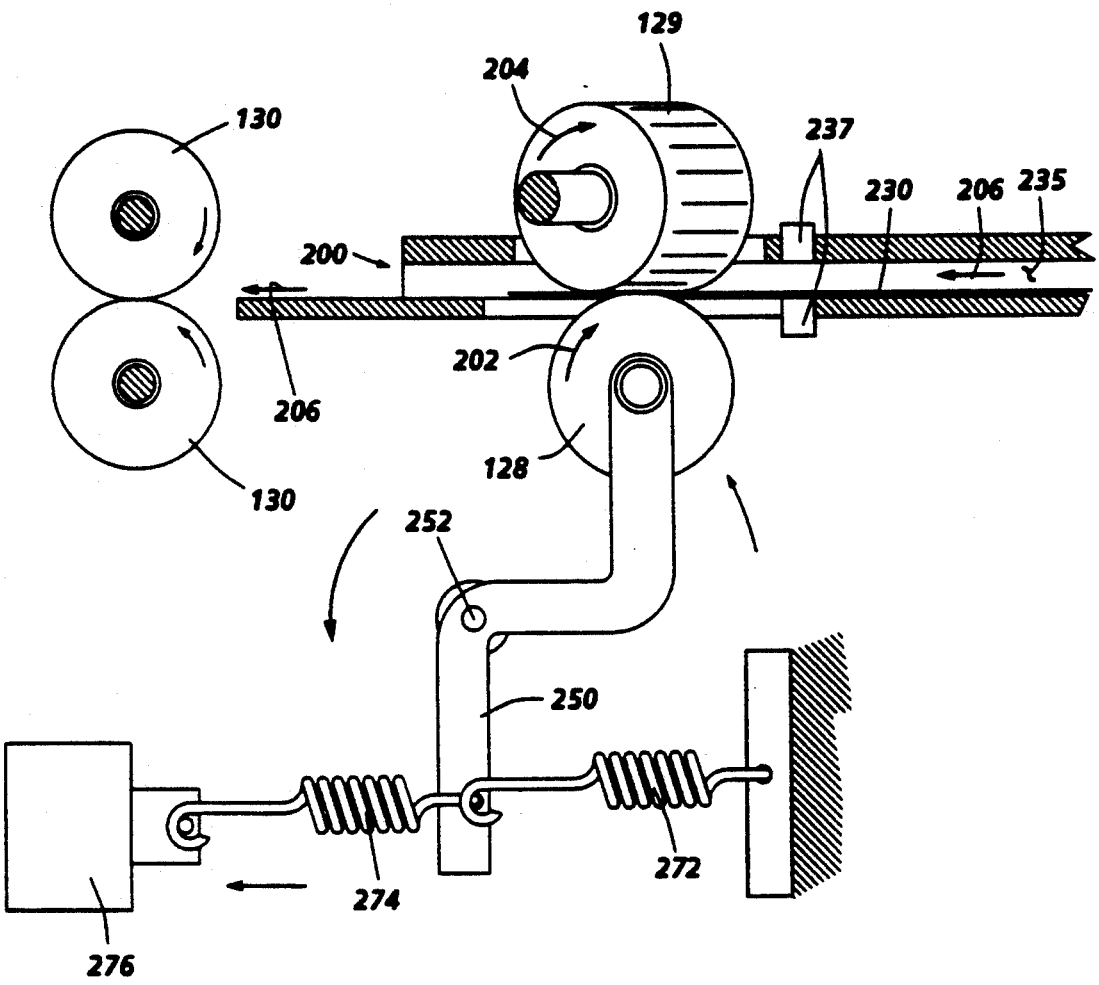
FIG. 6 is a side elevational view of another embodiment of the present invention similar to FIG. 5.

Referring now to FIG. 5 cross-rollers 128 and 129 are shown engaged. The cross-roller 128 is rotationally mounted on pivot arm 250 about pivot member 252. Coil spring 255 is mounted at one and to a fixed wall 257 and at the other to the pivot arm 250 opposite the cross-roller 128. Another coil spring 259 is mounted at one end to the pivot arm 250 and at the other end of the solenoid 261. As will be understood the coil spring 255 loads the cross-roller 128 to engage the driven cross-roller 128, and the actuation of solenoid 261 acting through coil spring 259 acts to increase the normal force at the engagement nip between the cross-rollers 128 and 129. The embodiment of FIG. 6 is substantially the same as the embodiment of FIG. 5, except that coil springs 272 and 274 are mounted in opposite directions, so that actuation of the solenoid 276 acts through coil spring 274 to lessen the normal force at the nip between cross-rollers 128 and 129 urged by coil spring 272. The detector 237 operates in substantially the same fashion as previously discussed above in connection with FIGS. 2 and 3 to provide a signal to the control unit to adjust the normal force by actuating the motive unit, the solenoid 220.

It should also be appreciated that by providing a linear motive unit, such as a variable input solenoid or linear motor, and a linear spring or springs the embodiments of the invention disclosed herein can be made to provide a continuous range of adjustment of the normal force between the cross-rollers. It should also be appreciated that several settings of the normal force can be established for ranges of document/sheet characteristics. That is for example, a large normal force for "heavy documents" (e.g. 50 lbs and higher), regular documents (e.g. between 50 lbs and 20 lbs.), light documents (e.g. under 20 lbs.). Few or less (i.e. two) increments can be provided as necessary for the particular application.

Figure 7:
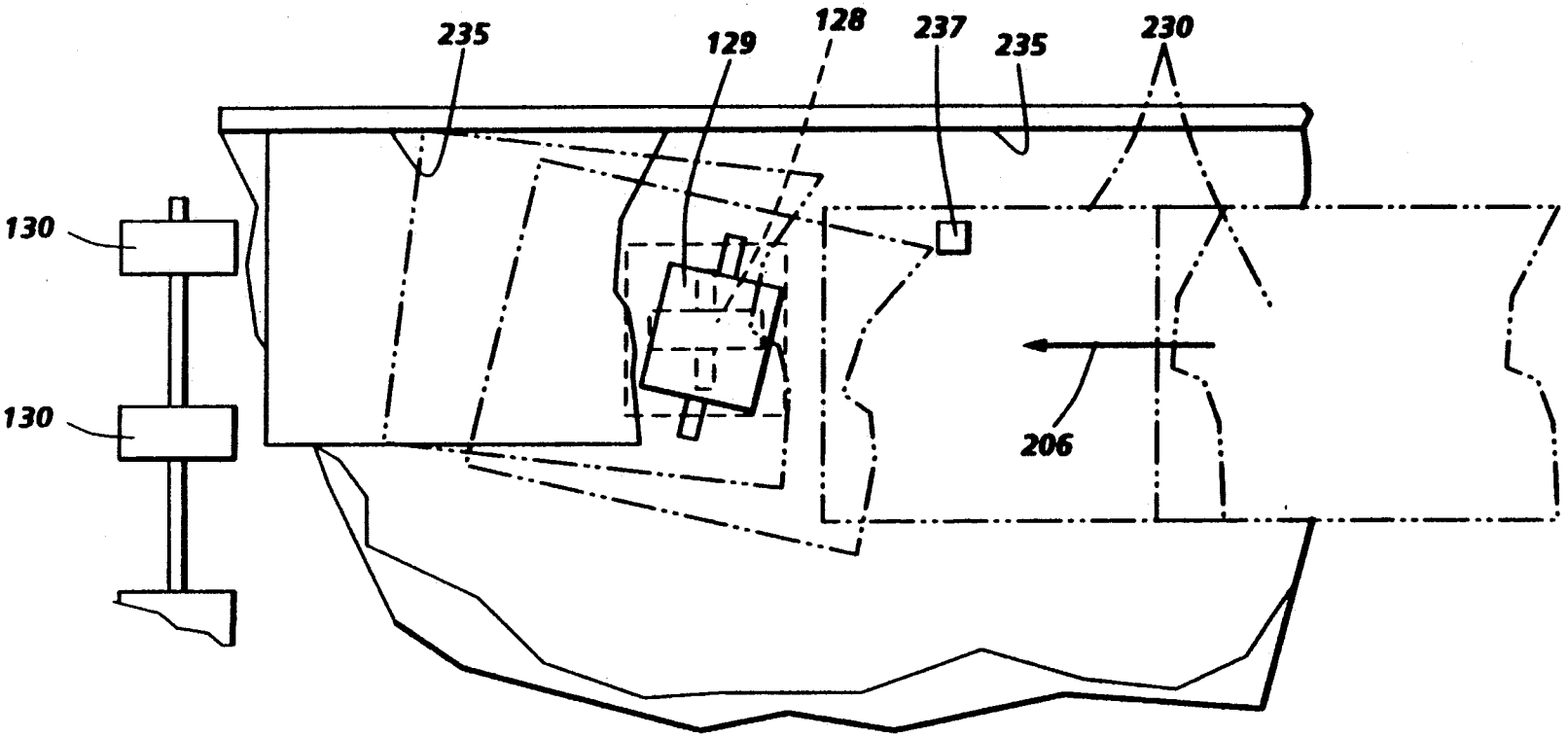
FIG. 7 is a top view demonstrating the functioning of the present invention.

A fuller explanation of the operation of the present invention may be had by reference to FIG. 7. Cross-rollers 128 and 129 are shown engaging the document 230 moving in the document path 200 and directing it along the path to the registration edge 235.

As should be now understood that cross-rollers of the type disclosed herein can be employed, for example, in the document handler 24 and copy sheet handler 39 of FIG. 1, particularly at the cross-roller sets 126 and 127, 128 and 129, 152 and 153, and 165 and 166. Further, it should also be understood that the sheet handlers of the present invention can be employed with image processing devices requiring the transport of sheets to and from processing stations in a registered fashion. Moreover, the control unit 100 of the exemplary copier of FIG. 1, for example, may be interconnected with the user interface panel 110 so that the actuation of the solenoid, which can be substituted with a stepper motor, and the like, is user selected according to characteristics of the sheet-like material used.

In recapitulation, a sheet handler suitable for use with an image scanner, a printer, and with copiers has been disclosed. The sheet handler has a sheet path through which sheet-like material is transported to and from processing stations. A cross-roller set is provided in the path where one roller is driven and one is loaded to engage the other roller. The rollers are skewed in the sheet path to drive the sheet-like material along the paper and lateral to engage and align along the registration edge. Remote means are provided to adjust the normal force between the cross-rollers to permit various sheet-like material to be registered without damage thereto.

It is, therefore, apparent that there has been provided in accordance with the present invention, a sheet handling device that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. A sheet handler for successively transporting sheets in a preselected direction to and from processing stations in image processing devices comprising:

a driven cross-roller;

a second cross-roller mounted for free rotation;

means for loading said rollers for applying a force urging the engagement of the rollers at a sheet receiving nip; and means for transporting sheets of varying characteristics through the sheet receiving nip, said transporting means comprising means for adjusting the force applied by said loading means to adjust the normal force on the sheets passing through the sheet receiving nip and means for actuating said adjusting means to adjust the force applied by said loading means.

2. The sheet handler of claim 1 further comprising a registration edge positioned along one edge parallel to the preselected direction wherein said cross-rollers urge the sheets passing through the sheet receiving nip to engage said edge and align along said edge.

3. The sheet handler of claim 2 further comprising a sheet path and means for driving sheets in said path in the preselected direction, wherein said registration edge forms a lateral side of said path.

4. The sheet handler of claim 1, wherein said adjusting means comprises means operatively associated with the loading means for resiliently adjusting the normal force on the sheets.

5. A sheet handler for successively transporting sheets in a preselected direction to and from processing stations in image processing devices comprising:

a driven cross-roller;

a second cross-roller mounted for free rotation;

means for loading said rollers for applying a force urging the engagement of the rollers at a sheet receiving nip; and means for adjusting the force applied by said loading means, said adjusting means comprising a spring member and an actuator means for applying a force through said spring member to alter the loading force applied by said loading means to adjust the normal force on the sheets passing through the sheet receiving nip so that transport of sheets of varying characteristics through the sheet receiving nip is enabled.

6. The sheet handler of claim 1 wherein said loading means comprises:

a frame;

an arm mounted pivotally on said frame, said arm rotationally supporting the second cross-roller; and a spring member connected to said arm to pivot said arm so that said cross-rollers engage one another.

7. A sheet handler for successively transporting sheets in a preselected direction to and from processing stations in image processing devices comprising:

a driven cross-roller;

a second cross-roller mounted for free rotation;

means for loading said rollers for applying a force urging the engagement of the rollers at a sheet receiving nip, said loading means includes a frame, an arm mounted pivotally on said frame, said arm rotationally supporting the second cross-roller, and a spring member connected to said arm to pivot said arm so that said cross-rollers engage one another; and means for adjusting the force applied by said loading means to adjust the normal force on the sheets passing through the sheet receiving nip, said adjusting means comprises a second spring member connected to said arm and actuator means for applying a force through said second spring member to alter the loading force applied by said loading means.

8. The sheet handler of claim 7 further comprising a registration edge positioned along one edge parallel to the preselected direction wherein said cross-rollers urge the sheets passing through the sheet receiving nip to engage said edge and align along said edge.

9. The sheet handler of claim 8 further comprising a sheet path and means for driving sheets in said path in the preselected direction, wherein said registration edge forms a lateral side of said path.

10. A sheet handler for successively transporting sheets in a preselected direction to and from processing stations in image processing devices comprising:

a driven cross-roller;

a second cross-roller mounted for free rotation;

means for loading said rollers for applying a force urging the engagement of the rollers at a sheet receiving nip, said loading means includes a frame, an arm mounted pivotally on said frame, said arm rotationally supporting said second cross-roller, and a spring member connected to said arm to pivot said arm so that said cross-rollers engage one another; and means for transporting sheets of varying characteristics through the sheet receiving nip, said transporting means comprising means for adjusting the force applied by said loading means to adjust the normal force on the sheets passing through the sheet receiving nip, said adjusting means comprises actuator means for applying a force through said spring member to alter the loading force applied by said loading means.

11. The sheet handler of claim 8 further comprising a registration edge positioned along one edge parallel to the preselected direction wherein said cross-rollers urge the sheets passing therebetween to engage said edge and align along said edge.

12. The sheet handler of claim 11 further comprising a sheet path and means for driving sheets in said path in the preselected direction, wherein said registration edge forms a lateral side of said path.

13. A sheet handler for successively transporting sheets in a preselected direction to and from processing stations in image processing devices comprising:

a driven cross-roller;

a second cross-roller mounted for free rotation;

means for loading said rollers for applying a force urging the engagement of the rollers at a sheet receiving nip;

means for adjusting the force applied by said loading means to adjust the normal force on the sheets passing through the sheet receiving nip; and means, in communication with said adjusting means, for detecting the characteristics of the sheets and controlling said adjusting means to regulate the normal force on the sheets.

14. A method for successively transporting sheets in a preselected direction to and from processing stations in image processing devices comprising the steps of:

driving a cross-roller skewed from the preselected direction;

positioning a second cross-roller mounted for free rotation adjacent said driven cross-roller;

loading said rollers to apply a force to urge engagement of the rollers at a sheet receiving nip whereby sheets passing between the cross-rollers move in a direction skewed from the preselected direction; and transporting sheets of varying characteristics through the sheet receiving nip, said transporting step comprising the steps of determining an appropriate force to apply between the cross-rollers and adjusting the force applied by said loading step, responsive to said determining step, to adjust the normal force on sheets passing through the sheet receiving nip.

15. The method of claim 14 further comprising the steps of:

providing a registration edge parallel to said preselected direction; and urging the sheets toward the registration edge as the material passes through the sheet receiving nip.

16. The method of claim 15 further comprising the step of moving sheets to the sheet receiving nip.

17. A method for successively transporting sheets in a preselected direction to and from processing stations in image processing devices comprising the steps of:

driving a cross-roller skewed from the preselected direction;

positioning a second cross-roller mounted for free rotation adjacent said driven cross-roller;

loading said rollers to apply a force to urge engagement of the rollers at a sheet receiving nip whereby sheets passing between the cross-rollers move in a direction skewed from the preselected direction;

adjusting the force applied by said loading step to adjust the normal force on sheets passing through the sheet receiving nip so that transport of sheets of varying characteristics through the sheet receiving nip is enabled;

sensing the characteristics of the sheets passing through the sheet receiving nip; and determining an appropriate force to apply between the cross-rollers.

18. A method for successively transporting sheets in a preselected direction to and from processing stations in image processing devices comprising the steps of:

driving a cross-roller skewed from the preselected directed;

positioning a second cross-roller mounted for free rotation adjacent said driven cross-roller;

loading said rollers to apply a force to urge engagement of the rollers at a sheet receiving nip whereby sheets passing between the cross-rollers move in a direction skewed from the preselected direction;

adjusting the force applied by said loading step to adjust the normal force on sheets passing through the sheet receiving nip so that transport of sheets of varying characteristics through the sheet receiving nip is enabled;

detecting the characteristics of the sheets; and controlling said adjusting means to regulate the normal force on the sheets.

19. An adjustable normal force edge registering device for registering sheets transported in a sheet handling device comprising:

a registration edge;

a drive and an idler roller engagedly mounted to form a sheet receiving nip, said rollers disposed to drive the sheets in the nip toward said registration edge; and means for transporting sheets of varying characteristics through the sheet receiving nip, said transporting means includes means for adjusting the normal force exerted on the sheets in the nip and means for actuating said adjusting means to vary the normal force on sheets in the nip.

20. An adjustable normal force edge registering device for registering sheets transported in a sheet handling device comprising:

a registration edge;

a drive and an idler engagedly mounted to form a sheet receiving nip, said rollers disposed to drive the sheets in the nip toward said registration edge;

means for adjusting the normal force exerted on the sheets in the nip to enable registration of the sheets of varying characteristics; and means for detecting the characteristics of sheets transported in the sheet handling device and means for controlling said adjusting means in response to said detecting means.

21. A sheet handler for successively transporting sheets in a preselected direction to and from processing stations in image processing devices comprising:

a driven cross-roller;

a second cross-roller mounted for free rotation;

means for loading said rollers for applying a force urging the engagement of the rollers at a sheet receiving nip;

means for adjusting the force applied by said loading means to adjust the normal force on the sheets passing through the sheet receiving nip so that transport of sheets of varying characteristics through the sheet receiving nip is enabled; and means, in communication with said adjusting means, for detecting the characteristics of the sheets and controlling said adjusting means to regulate the normal force on the sheets.

* * * * *